United States Patent [19]

van der Laan

[11] 3,937,346

[45] Feb. 10, 1976

[54] MOVABLE STACKING DEVICE

[75] Inventor: Hans Robert van der Laan, Kamerik, Netherlands

[73] Assignee: Cubic Handling Systems N.V., Belgium

[22] Filed: Sept. 4, 1974

[21] Appl. No.: 503,103

[30] Foreign Application Priority Data

Sept. 7, 1973 Netherlands ..... 7312385

[52] U.S. Cl. ..... 214/730; 187/9 E; 187/95

[51] Int. Cl.² ..... B66F 9/14

[58] Field of Search ..... 214/660, 730, 731; 187/9 R, 9 E, 95

[56] References Cited

UNITED STATES PATENTS

| | | | |
|---|---|---|---|
| 3,061,046 | 10/1962 | Gunning | 187/95 |
| 3,460,699 | 8/1969 | Ohntrup | 214/730 |
| 3,851,732 | 12/1974 | Wagner et al. | 187/9 E |

*Primary Examiner*—Robert J. Spar
*Assistant Examiner*—Lawrence J. Oresky
*Attorney, Agent, or Firm*—Bucknam and Archer

[57] ABSTRACT

A moveable stacking device having a mobile substructure which carries a tower with a fixed outer frame and an inner frame guided by the outer frame for vertical movement relative thereto. An operating platform is guided by the inner frame for vertical movement relative thereto, and carries a transversely extending base frame on which a rotation head is guided for horizontal movement. The rotation head carries a lifting fork means which is rotatable about a generally vertical axis.

10 Claims, 4 Drawing Figures

MOVABLE STACKING DEVICE

The present invention relates to a movable stacking device comprising a substructure, a vertical mast vertically arranged thereon and composed of a fixed outer frame and an inner frame vertically guided by the outer frame, an operating platform vertically guided by the inner frame and comprising a base frame extending transversely to the substructure, a rotation head horizontally guided by the base frame and a fork device or similar means adapted to carry a load and being supported by the rotation head for rotation about a vertical shaft, the outer frame and the inner frame of the mast each consisting of two spaced sections, such as channel beams or I beams, extending transversely to the substructure, the webs of said sections extending in longitudinal direction of the substructure, rollers or similar means being mounted on the sections of one frame which act on flanges of the adjacent sections of the other frame of the mast and further rollers or similar means being mounted on the operating platform which act on the flanges of the inner frame.

Such a movable stacking device is well known in practice and is used in particular for stacking and unstacking of general cargo in warehouses. In order to have the warehouses occupy a minimum of ground surface one uses very high warehouses, of a magnitude of 10 meters, and tries to keep the width of the aisles between the various racks of the warehouse as small as possible. It goes without saying that the width of the aisles should exceed the total width of the movable stacking device, but one wishes to keep the clearance on both sides of the stacking device as small as possible. In this respect one has in mind a clearance on either side of the stacking device of a magnitude of 100 mm.

It will be obvious that when only very little clearance is available between the stacking device and the racks on either side and, moreover, the stacking device should be capable of operating up to a height of about 10 meters, very high requirements are set for the rigidity of the structure of the stacking device. When the fork normally points in the forward direction the load carried by the fork device or similar means tries to tilt the stacking device in the forward direction. This is counteracted by the counter weight which normally is provided on the substructure. This forward tilting movement, however, does not influence the lateral clearance between the stacking device and the racks on either side thereof. This forward or possibly rearward tilting movement is taken up in a known manner by the rollers between the sections of the inner frame and the outer frame and by the rollers between the operating platform and the sections of the inner frame. The moment as a result of the tilting movement in forward or possibly rearward direction is shown in FIG. 1. of the drawings as M1. Taking up this moment does not present particular difficulties when the prongs of the fork device are pointing straight ahead and extend in the centre of the stacking device, because then the sections are loaded parallel to the web of each section. Since sections are destined to take up loads in said direction this does not create any difficulties.

However, if the rotation head has been moved outwards relative to the base frame of the operating platform, it is obvious that the weight G of the load supported by the fork device tries to tilt in the lateral direction. Consequently a moment is created which is designated as M2 in FIG. 1. This moment still increases if, moreover, the prongs of the fork device point entirely in the lateral direction, as is the case in FIG. 1. It is obvious that said moment M2 does influence the lateral clearance between stacking device and racks. In the case of the known stacking devices generally no efficient measures are taken to take up said moment M2. Naturally one may have the rollers act on the webs of the sections, but in that event the sections are loaded in a direction which is not favourable for them.

In the case of considerable lifting heights, in particular if one has to drive on not entirely flat floors, one has to deal not only with forward, rearward and lateral movements, but, moreover, torsional movements or vibrations play a considerable part. These bring about a moment M3. These torisional movements in the lifting mast may mean a considrable lateral deflection for the fork prongs so that additional lateral clearances should be provided for between the stacking device and the racks.

This moment is not taken up well either by the known stacking devices.

A stacking device of the afore-mentioned type is described among other things in the British patent specification No. 1,210,349, although in said patent specification not all details are described and, moreover, in the stacking device according to said literature it is not an operating platform that moves upwards along the inner frame, but only a carrier device for the fork device. In the case of the stacking device according to the British patent specification No. 1,210,349 the operator remains on the substructure of the stacking device. Stacking devices in which the operator does move upwards are known per se and and are also mentioned in the British patent specification No. 1,210,349.

The invention aims at avoiding the drawbacks of the generally known stacking device and this is accomplished according to the invention in that the outer frame and the inner frame each comprise in addition a vertical box girder, said box girders being arranged one behind the other on the longitudinal axis of the substructure, the box girder of the inner frame being vertically movable relative to the box girder of the outer frame by means of guide plates or the like, but being unable to move transversely thereto, that the sections are each time connected to the corresponding box girder by rigid transverse beams and that the side of the operating platform remote from the base frame comprises additional rollers or similar means co-operating with a vertically extending guide rail on the box girder of the inner frame.

According to the invention therefore both the outer frame and the inner frame are enlarged with a torsion-free box girder. In the present stacking device, like in the known stacking devices the moment M1 is taken up by the flanges of the sections. The moment M2, however, is not transmitted to the sections, but directly to the box girders which on account of their shape offer a great resistance. The moment M2 is transmitted from the operating platform via the guide rail to the box girder of the inner frame and subsequently via the guide plates to the box girder of the outer frame. In order to have a good view on the load and also to receive with this type of stacking device orders by hand from the racks it is desirable that the operator is moved upwards on the operating platform along with the load. However, it is a condition that the operator is seated as much as possible to the rear between the foremost sections. With the design according to the present patent application with rearwardly arranged box girders the operator is placed so far to the rear that the view remains free and at the same time the moment M1 is small relative to the foremost sections.

The moment M3 is now taken up by the torsion-free box girders in combination with the sections which are loaded in a direction favourable to them.

A stacking device in which one has endeavoured to take up all moments in a satifactory way is described among other things in the British patent specification No. 920,053. In this instance the mast is constituted by a rectangular tower structure. It will be obvious that structurally this a very complicated form and that, moreover, it would not be possible to have the operator move upwards in a position which is as much as possible to the rear without allowing the moment M1 to be disproportionally large. Nothing is said about a lateral movement of the fork device.

According to the invention the cross beams connecting the sections to the box girders are preferably likewise constructed as box girders. Consequently a very fine design is arrived at according to which no longitudinal stiffening is required and a good view for the operator towards the rear is maintained.

According to the invention all composite moments and forces in the structure are divided in the correct manner and consequently the sections, the box girders, the guide plates and the rollers are loaded in a direction in which the greatest resistance against said load direction is guaranteed. As a result the lateral tolerance between stacking device and racks is chosen as small as possible.

Said lateral tolerance between stacking device and racks, however, is also influenced by the design of the rotation head. In order to keep the space occupied by the rotation head as small as possible it is of importance to reduce the width of the rotation head to a minimum. In the case of the known stacking devices said width is rather considerable because in order to take up the moment M2 the rotation head must be guided tilt-free by the base frame of the operating platform. This means in general that at least two rollers should be arranged transversely and one beside the other. It is obvious that consequently the width of the rotation head is considerable. A similar design is known in practice and is described among other things in the British patent specification No. 750,793, in particular FIGS. 11 and 12.

The invention aims at maintaining the rotation head as narrow as possible so that one may do each time with only one roller in the transverse direction. According to the invention this is rendered possible in that a stacking device, in which the part of the rotation head co-operating with the base frame of the operating platform is U-shaped and at the lower side of the upper flange and at the upper side of the lower flange of the U a roller or similar means is mounted which is rotatable about a shaft extending perpendicularly to the upper flange and the lower flange respectively, said rollers or similar means co-operating with flanges on the base frame which are situated in vertical planes and extend transversely to the substructure and on the web of the U of the rotation head a roller or similar means is mounted which is rotatable about a shaft extending perpendicularly to the web, said roller or similar means being adapted to co-operate with a guide path of the base frame situated in a horizontal plane and likewise extending transversely to the base frame, is characterized in that each time only one roller or the like is applied, the tilting moment of the rotation head relative to the base frame being taken up in the plane of the base frame by an intermediate carriage which is guided tilt-free transversely to the substructure by the base frame and to which the rotation head is connected.

The moment M2 which is exercized by the weight G of the load on the fork device on the base frame of the operating platform is therefore not taken up anymore directly by the guide and carrier rollers between the rotation head and the base frame but by the tilt-free guiding system of an intermediate carriage in the base frame. As a result one may do each time with only one roller so that the rotation head may be kept narrow.

In addition the intermediate carriage preferably comprises at least two rollers or the like mounted transversely to the substructure and one beside the other, said rollers being rotatable about shafts mounted perpendicularly to the intermediate carriage, said rollers or the like co-operating with horizontal flanges on the base frame, above and below the rollers or the like, there being mounted at the four ends of the rectangular intermediate carriage chain wheels which are rotatable about vertical shafts and around the upper and lower pair of chain wheels each time an endless chain is laid of which each time one point is fixedly connected to the rotation head and one point fixedly to the base frame. The use of chains and chain wheels prevents any tendency to tilt of the rotation head relative to the base frame. The chain transmission presents still another particular advantage, namely that at a complete stroke of the rotation head transversely to the substructure the intermediate carriage only carries out half a stroke. This may be used advantageously for the lateral movement of the rotation head. According to the invention in a stacking device including a hydraulic jack or some other mechanism for moving the rotation head relative to the base frame of the operating platform the jack or similar means acts on the one hand on a point of the base frame and on the other hand on a point of the intermediate carriage, the chains ensuring the doubling of the stroke of the rotation head.

As already stated the fork device, while being rotatable about a vertical shaft, is connected to the free end of the rotation head. The fork device may thereby be rotated through 180° relative to the rotation head. The positions to the extreme left and to the extreme right of the fork device will be chosen when putting loads into racks, the stacking device being positioned in the aisle between the racks. In connection with the limited space in the racks between the goods and in order to get the fork device out easily it is very important to have the possibility of tilting the prongs of the fork device slightly in the rearward direction when the fork device has been rotated completely to the left or to the right. By tilting the fork device slightly rearwards one creates as it were a bias so that consequently when the load is on the fork device the prongs of said fork device will be horizontal again. In order to render this slight tilting movement of the fork device possible the rotation head should be able to be tilted slightly relative to the base frame of the operating platform. According to the invention this is accomplished in that of one of the chains the point with which the chain is fixedly connected to the base frame is somewhat adjustable relative to the base frame in order to effect a slight tilting of the rotation head relative to the base frame. Preferably the point of the upper chain is adjustable.

In the known stacking devices such a tilting movement is also possible in general, but this is effected by separate cylinders in the fork device itself. For shifting the anchoring point of the chain one may use a hydraulic cylinder or similar means.

The invention will now be further explained with reference to the drawings in which FIG. 1 is a view in perspective of the stacking device according to the invention;

Figure 1:
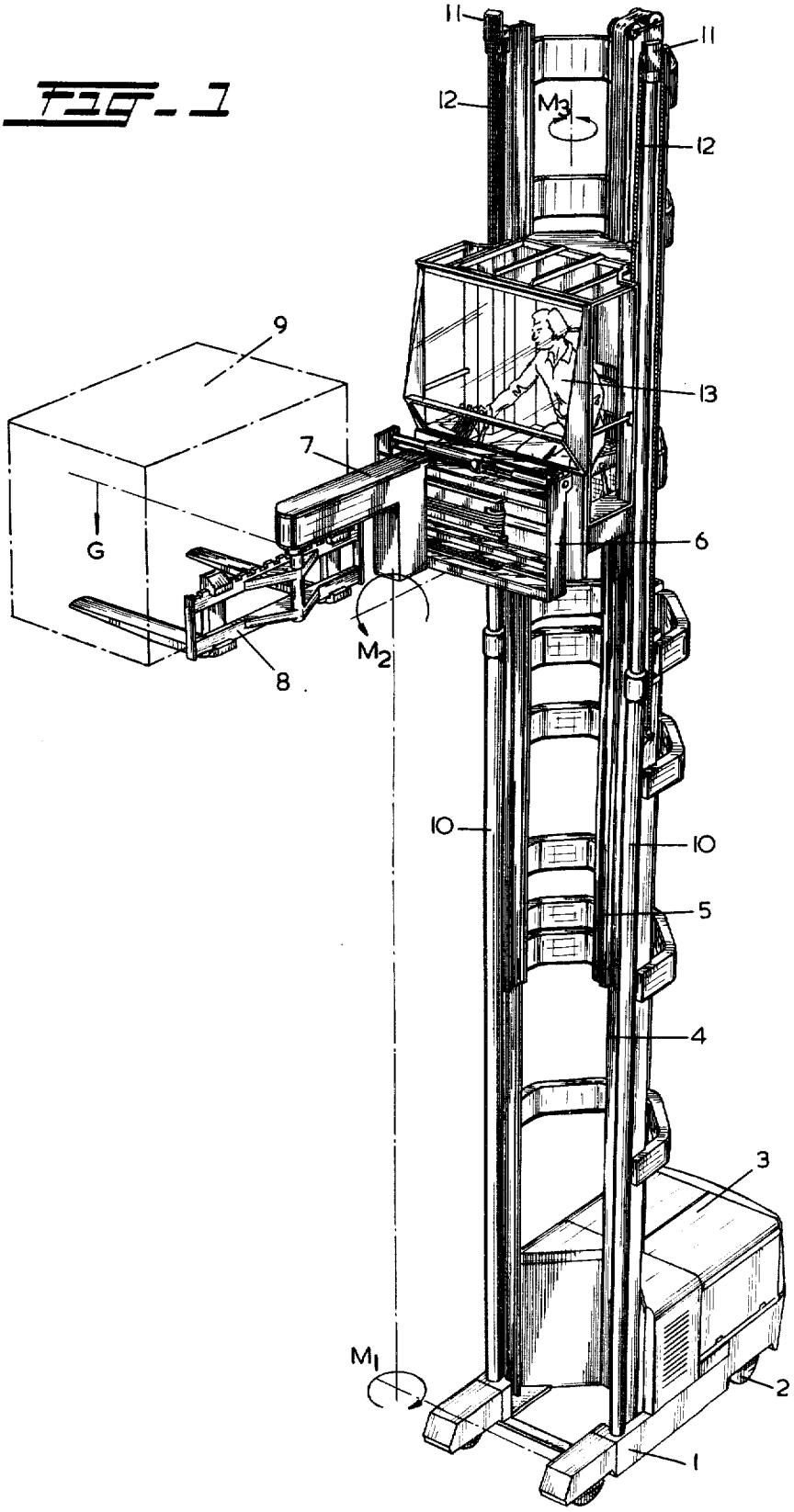

In FIG. 1 the substructure of the stacking device according to the invention is indicated by reference numeral 1, the wheels by 2, the counter-weight and the motor compartment by 3, the fixed outer frame of the mast structure by 4, the inner frame movable relative to the outer frame 4 by 5, the operating platform movable relative to the inner frame 5 by 6, the rotation head by 7, and the fork device by 8. The load to be lifted is schematically shown as a cube-shaped load and is designated by 9. In a known manner the operating platform is lifted with the aid of two hydraulic lifting jacks designated by 10, of which the end of each piston rod acts on a sprocket wheel 11 located at the upper end of the inner frame 5, a chain 12 being led over said sprocket wheel, one end of said chain being fixedly connected to the outer frame 4 and the other end being fixedly connected to the operating platform 6. Thus by expansion of the jacks 10 the operating platform 6 is moved upwards with double speed of the innner frame 5. All this belongs to the prior art. It is obvious that on account of the fact that the operator, designated by 13, moves along upwards, this man maintains a good view on th load 9 and the points in the racks (not shown) from where the load 9 has to be taken away or where the load 9 has to be placed.

FIG. 1 shows, moreover, the moments M1, M2 and M3 discussed in the preceding text.

Figure 2:
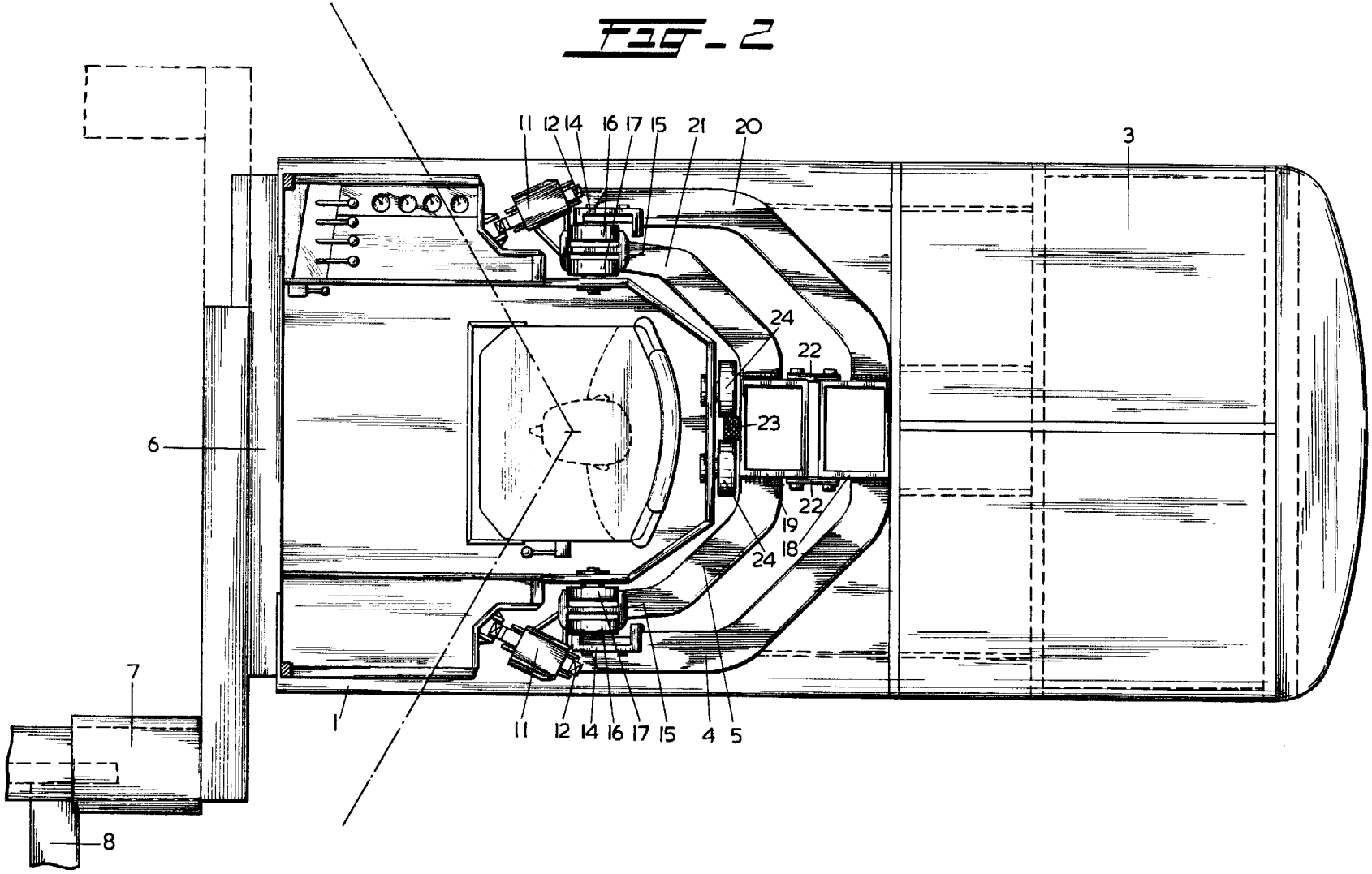
FIG. 2 is a top plan view of the stacking device according to the invention on an enlarged scale.

In order to keep the aisle width in the warehouses as small as possible a non-deformable mast structure is of predominant importance. Similar to the known stacking device the outer frame 4 comprises two channel beams facing each other, see FIG. 2, said channel beams being designated by 14. The inner frame 5 comprises in a known manner two I beams designated by 15. The inner frame 5 is vertically guided in the outer frame 4 with the aid of two sets of rollers. One set of rollers, indicated by 16 in FIG. 2, is secured in the upper end of the outer frame, said rollers being rotatable about shafts extending perpendicularly to the web of the channel beams 14. The rollers 16 co-operate with the outer flanges of the I beams 15 of the inner frame 5. In the same manner the other set of rollers (not shown) is secured to the web of the I beams 15 and the inner frame 5, namely to the lower end of the inner frame 5. These rollers (not shown) co-operate with the flanes of the channel beams 14 of the outer frame 4. In this known way the I beams 15 of the inner frame 5 are guided in vertical direction by the channel beams 14 of the outer frame. The operating platform 6 comprises in a known manner at the left hand and right hand side two sets of rollers designated by 17. Said rollers 17 are guided between the other flanges of the I beams 15 of the inner frame 5. In this manner a moment M1 exercized by the weight G of the load 9 in forward direction is transmitted to the substructure 1 of the stacking device. Efforts are made to maintain said moment M1 as small as possible by moving the position of the operator as much as possible to the rear.

When the rotation head 7 is moved outwards and, moreover, the teeth of the fork device 8 are pointing entirely outwards, as shown in FIG. 11, it is clear that the weight G of the load 9 and, moreover, the own weight of the fork device and of the rotation head tend to tilt the stacking device sideways. Consequently this produces the moment M2. In order to take up said moment M2 satisfactorily in the first place the rotation head 7 should be guided tilt-free by the operating platform 6, but, moreover, the mast structure should be designed such that said moment M2 can be taken up. For this purpose according to the invention both the inner frame and the outer frame is provided with its own box girder designated by 18 and 19 respectively.

As is apparent from FIG. 2 the box girders 18 and 19 are disposed on the centre line of the stacking device one behind the other. Box girder 18 is connected via torsion-rigid transverse beams 20 to the channel beams 14. The same holds for the box girder 19 which is connected via torsion-rigid transverse beams to I beams 15. The transverse beams 20 and 21 are curved and in cross-section also box-shaped. The box girder 19 of the inner frame 5 is adapted to be moved in vertical direction relative to the box girder 18 of the outer frame 4, but is held in transverse direction by guide plates designated by 22. One set of guide plates 22 are secured to the upper end of the box girder 18 and another set of guide plates 22 are secured to the lower end of box girder 19. As a result of the rearwardly arranged box girders 18 and 19 and the curved transverse members 20 and 21 a kind of spine-like design of the inner frame 4 and the outer frame 5 is arrived at. In addition to the fact that this design is very torsion-rigid, it also offers the possibility to place the operator's seat as much as possible to the rear and yet to maintain a good view on the load, see FIG. 2. At the front of the box girder 19 there is secured a vertically extending guide rail 23 with which two sets of superimposed rollers 24 may co-operate, said rollers being mounted at the rear side of the operating platform 6.

When the weight G of the load 9 exercizes a moment M2, this is transmitted from the operating platform 6 by the rollers 24 to the guide rail 23 and therefore to the box girder 19 and subsequently via the guide plates 22 to the box girder 18. The channel beams 14 and the I beams 15 are thus enntirely relieved from said moment M2.

The previously moment M3 is likewise taken up by the box girders 18 and 19 which in consequence of their shape are very suitable to take up torsion stresses, in combination with the sections 14 and 15 which are loaded in a direction suitable for them.

A second measure which contributes to keeping the aisle widths in the warehouses as small as possible is a reduction of the width of the rotation head. If namely one enters an aisle with the fork device already swung laterally out, the rotation head is in the outermost right hand position, shown in FIG. 1. In this way the load 9 projects at the left as little as possible beyond the stacking device. In this position the load will project at the left the more according as the rotation head is broader. A rotation head which is as narrow as possible therefore reduces the necessary clearance between stacking device and racks.

In the case of the known rotation heads the the width must be rather considerable because for a tilt-free guiding system of the rotation head relative to the base frame of the operating platform always two rollers one beside the other are necessary and, moreover, a complicated and vulnerable gear rack guide system is required. Now if one could do each time with only one roller, then obviously the rotation head may be narrower. The transverse guiding system of the operating platform according to the invention is diagrammatically shown in FIG. 3 in an exploded view in perspective.

The operating platform 6 comprises a base frame integral therewith. Said base frame mainly comprises a horizontal channel beam 25 at the top, a horizontal channel beam 26 at the bottom and a horizontal I beam 27 extending parallel to said channel beams 25 and 26. At the ends of the channel beams 25 and 26 and the I beam are connected by vertical end plates designated by 28 and 29. The base frame consisting of the channel beams 25 and 26, the I beam 27 and the end plates 28 and 29 constitutes a rigid unit.

Figure 3:
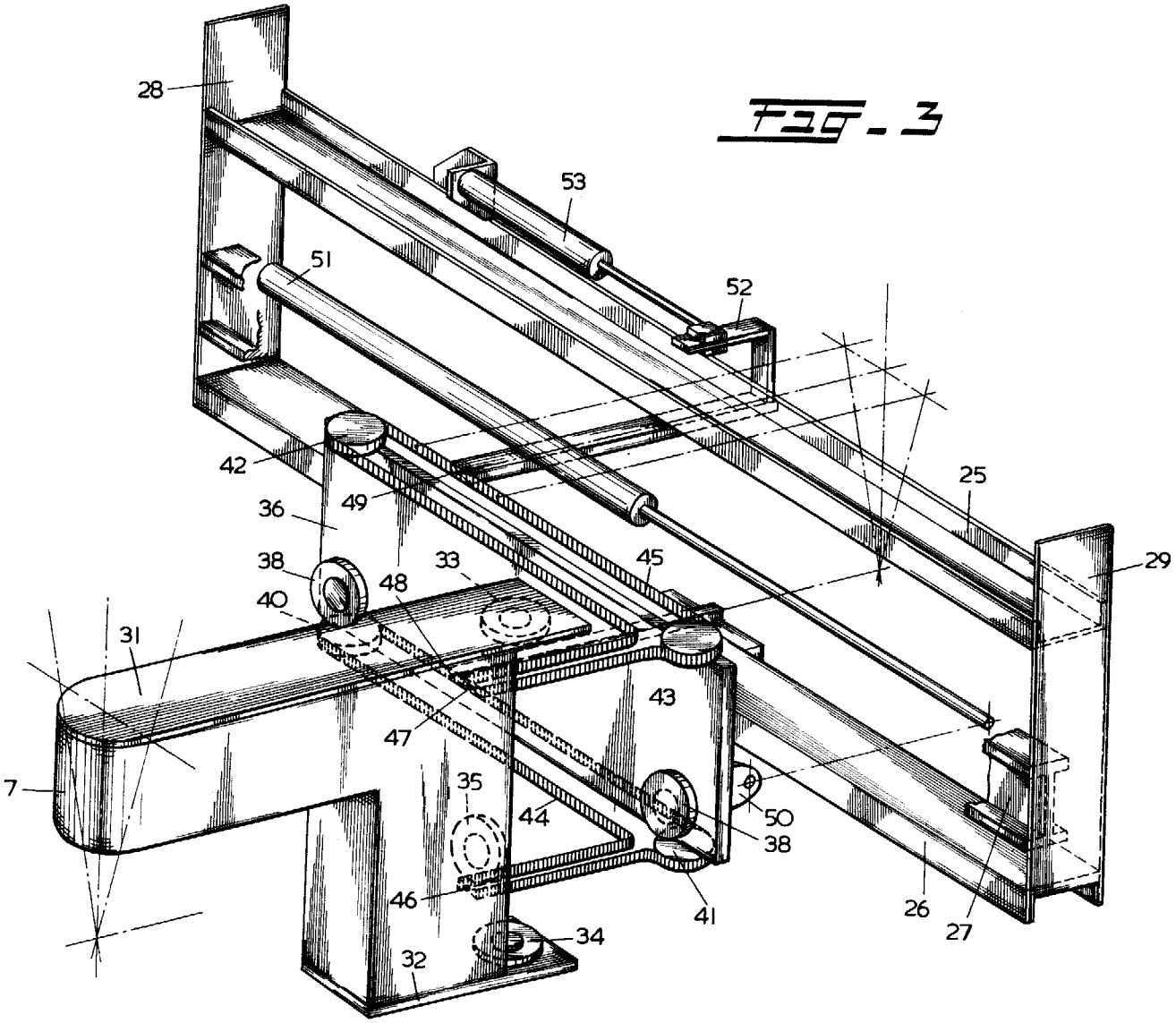
FIG. 3 is an exploded diagrammatical view of the base frame of the operating platform with the rotation head thereon.
Figure 4:
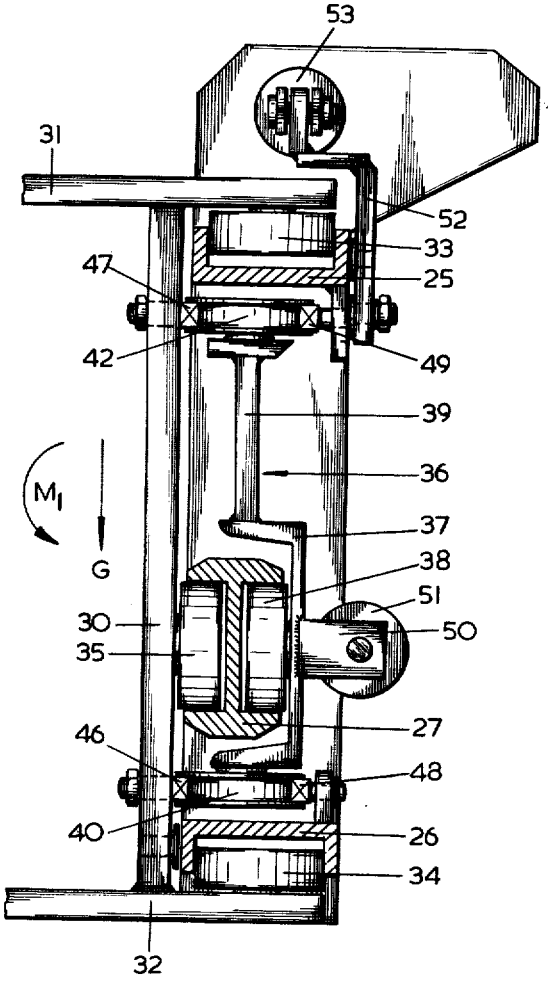
FIG. 4 is a cross-section through the operating platform with part of the rotation head.

As is apparent from FIGS. 3 and 4 the part of the rotation head 7 facing the base frame has a U-shape. Said U-shape is formed by a vertical web 30, and upper flange 31 and a lower flange 32. The rotation head 7 has been manufactured in a known manner by welding. In the upper flange 31 there is mounted a roller 33 which is rotatable about a vertical shaft. Similarly there is mounted on the flange 32 a roller 34 which is likewise rotatable about a vertical shaft. The rollers 33 and 34 act on the flanges of the channel beams 25 and 26 respectively. Said rollers 33 and 34 transmit in a known manner the moment M1 from the rotation head 7 to the operating platform.

For taking up the weight of the load 9 there is provided a roller 35 which is mounted on the web 30 and is rotatable about a horizontal shaft. Said roller cooperates with a set of flanges of the I beam 27. Since the rollers 33, 34 and 35 are of the single type, said guiding system is not capable of taking up the lateral moment M2. For taking up said lateral moment M2 a separate intermediate carriage is used, designated by 36, which, while guided in the horizontal direction, is supported by the base frame. To this end said intermediate carriage 36 comprises a channel beam 37 on the web of which two rollers 38 are mounted which are rotatable about a horizontal shaft. Said rollers 38 are situated considerably apart in horizontal direction and co-operate with the other flanges of the I beam 27. It will be clear that in this way the channel beam 37 of the intermediate carriage 36 is guided tilt-free in the horizontal direction relative to the base frame.

On the upper flange of the channel beam 37 there is welded a plate, designated by 39, which together with the channel beam 37 constitutes the frame of the intermediate carriage 36. In FIG. 3 said frame is diagrammatically shown as a flat plate. On the four corners of said frame of the intermediate carriage 36 each time a chain roller is mounted. Said chain rollers are shown in FIG. 3 by reference numerals 40, 41, 42 and 43 and are rotatable about vertical shafts. In FIG. 4 only the chain rollers 40 and 42 are visible.

Around the chain rollers 40 and 41 there is laid an endless chain 44 and around the chain rollers 42 and 43 and endless chain 45.

Both the chain 44 and the chain 45 are connected by means of a chain anchor 46 and 47 respectively with the web 30 of the rotation head 7. The chains 44 and 45 are each connected via another chain anchor, designated by 48 and 49 respectively, to a part of the base frame.

It will be clear that when the rotation head 7 moves over the entire width of the base frame, the intermediate carriage 36 only covers half of the path of movement.

The chain transmission between the rotation head and the intermediate carriage prevents the rotation head from tilting laterally. In this manner the lateral moment M2 is effectively taken up without the necessity of the rotation head being wide. The intermediate carriage 36 is also used for the lateral movement of the rotation head relative to the base frame. At a point of the intermediate carriage 36, designated by 50, the end of a hydraulic jack 51 acts, the other end of which being secured in the base frame, see FIGS. 3 and 4. For laterally moving the rotation head 7 the intermediate carriage 36 is therefore laterally shifted. The chains 44 and 45 bring about a doubling of the stroke.

When the prongs of the fork device point in the lateral direction , as shown in FIG. 1, it is often preferable to tilt the fork device slightly backwards in order to give the prongs an inclined position. In this manner the fork device is given as it were a bias which is removed when the load 9 reposes on the prongs of the fork device. This slight tilting of the prongs of the fork device is of importance in connection with the limited space in the racks and for easily introducing the prongs of the fork device into the restricted free space of a pallet. Now according to the invention this slight tilting in backward direction of the rotation head 7 may be effected in a simple way by not connecting the chain anchor 49 directly to the base frame but by connecting it with a bow designated by 52 in FIG. 4, on which bow 52 there acts a hydraulic cylinder 53 which at the other end is secured to the base frame. The hydraulic cylinder 53 can now adjust the chain anchor somewhat and as a result the entire rotation head 7 with the fork device can be tilted somewhat backwards.

The invention provides a stacking device capable of operating up to a very considerable height with a minimum clearance between the stacking device and the racks of a warehouse.

According to the invention the shafts of the rollers which ensure the guiding of the sections and the guide plates can be removed from the sections and the box girders respectively when the mast is in retracted condition. In this way the inner frame can be removed from the outer frame without the necessity of sliding the inner frame upwards out of the outer frame. This is of great importance in connection with repairs and the like.

I claim:

1. A movable stacking device comprising a substructure, a vertical mast vertically arranged thereon and composed of a fixed outer frame and an inner frame vertically guided by the outer frame, an operating platform vertically guided by the inner frame and comprising a base frame extending transversely to the substructure, a rotation head horizontally guided by the base frame and a fork means adapted to carry a load and being supported by the rotation head for rotation about a vertical shaft, the outer frame and the inner frame of the mast each consisting of two spaced channel or I-beam sections extending transversely to the substructure, the webs of said sections extending in longitudinal direction of the substructure, rollers or similar means being mounted on the sections of one frame which act on flanges of the adjacent sections of the other frame of the mast and further rollers or similar means being mounted on the operating platform which act on the flanges of the inner frame, characterized in that the outer frame and the inner frame each comprise in addition a vertical box girder, said box girders being arranged on behind the other on the longitudinal axis of the substructure, the box girder of the inner frame being vertically movable relative to the box girder of the outer frame by means of a guide means, but being unable to move transversely thereto, that the sections are each connected to the corresponding box girder by rigid transverse beams and that the side of the operating platform remote from the base frame comprises additional rollers or similar means cooperating with a vertically extending guide rail on the box girder of the inner frame.

2. A stacking device according to claim 1, characterized in that the transverse beams are likewise of the box girder type.

3. A stacking device according to claim 1, characterized in that in the retracted position of the mast the rollers or similar means with the corresponding shafts and guide plates may be removed from the sections and the box girders respectively.

4. A stacking device according to claim 1, characterized in that the operating platform is arranged within the space arcuate in top plan view and formed by the box girder, the two sections and the transverse beams of the inner frame.

5. A stacking device according to claim 1, in which the part of the rotation head co-operating with the base frame of the operating platform is U-shaped and at the lower side of the upper flange and at the upper side of the lower flange of the U a roller or similar means is mounted which is rotatable about a shaft extending perpendicularly to the upper flange and the lower flange respectively, said rollers or similar means co-operating with flanges on the base frame which are situated in vertical planes and extend transversely to the substructure, and on the web of the U of the rotation head a roller or similar means is mounted which is rotatable about a shaft extending perpendicularly to the web, said roller or similar means being adapted to co-operate with a guide path of the base frame situated in a horizontal plane and likewise extending transversely to the base frame, characterized in that each time only one roller or the like is applied, the tilting moment of the rotation head relative to the base frame being taken up in the plane of the base frame by an intermediate carriage which is guided tilt-free transversely to the substructure by the base frame and to which the rotation head is connected.

6. A stacking device according to claim 5, characterized in that the intermediate carriage comprises at least two rollers or the like mounted transversely to the substructure and one beside the other, said rollers being rotatable about shafts mounted perpendicularly to the intermediate carriage, said rollers or the like co-operating with horizontal flanges on the base frame, above and below the rollers or the like, there being mounted at the four ends of the rectangular intermediate carriage chain wheels which are rotatable about vertical shafts and around the upper and lower pair of chain wheels each time an endless chain is laid of which each time one point is fixedly connected to the rotation head and one point fixedly to the base frame.

7. A stacking device according to claim 5, characterized in that the roller or similar means which is mounted on the web of the rotation head and the rollers or similar means which are arranged one beside the other and are mounted on the intermediate carriage act on the upper and lower flanges of an I beam of the base frame at the front and the rear side thereof respectively.

8. A stacking device according to claim 5, including a hydraulic jack or some other mechanism for moving the rotation head relative to the base frame of the operating platform, said jack or similar means acting on the one hand on a point of the base frame, characterized in that said jack or similar means acts on the other hand on a point of the intermediate carriage, the chains ensuring the doubling of the stroke of the rotation head.

9. A stacking device according to claim 5, characterized in that of one of the chains the point with which the chain is fixedly connected to the base frame is somewhat adjustable relative to the base frame in order to effect a slight tilting of the rotation head relative to the base frame.

10. A stacking device according to claim 9, characterized in that the point of the upper chain is adjustable.

* * * * *